US007677928B2

(12) United States Patent
Fuerst

(10) Patent No.: US 7,677,928 B2
(45) Date of Patent: Mar. 16, 2010

(54) FILTER CONNECTOR

(75) Inventor: Robert M. Fuerst, Bloomfield, MI (US)

(73) Assignee: Molex Incorporated, Lisle, IL (US)

( * ) Notice: Subject to any disclaimer, the term of this patent is extended or adjusted under 35 U.S.C. 154(b) by 36 days.

(21) Appl. No.: 11/795,353

(22) PCT Filed: Jan. 13, 2006

(86) PCT No.: PCT/US2006/001086

§ 371 (c)(1),
(2), (4) Date: Apr. 7, 2008

(87) PCT Pub. No.: WO2006/076495

PCT Pub. Date: Jul. 20, 2006

(65) Prior Publication Data

US 2009/0053936 A1 Feb. 26, 2009

(51) Int. Cl.
*H01R 13/66* (2006.01)

(52) U.S. Cl. ..... 439/620.09

(58) Field of Classification Search .....
439/620.09–620.14, 936
See application file for complete search history.

(56) References Cited

U.S. PATENT DOCUMENTS 5,624,277 A * 4/1997 Ward ..... 439/620
6,467,165 B1 * 10/2002 Glynn ..... 29/876

* cited by examiner

*Primary Examiner*—Ross N Gushi
(74) *Attorney, Agent, or Firm*—Larry I. Golden

(57) ABSTRACT

A filter connector includes a dielectric housing having a mounting face. At least one row of terminal-receiving passages are formed in the housing through the mounting face. A row of filter-receiving pockets are formed in the housing through the mounting face respectively in alignment with the passages, and with one side of each pocket communicating with its respective passage. A slot is formed in the mounting face of the housing and extends along the row of pockets in communication with opposite sides thereof. A plurality of terminals are mounted into the passages. A plurality of filters are inserted into the pockets through the mounting face, with one side of the filters respectively engageable with the terminals. A single shorting bar is inserted into the slot in the housing through the mounting face and into engagement with opposite sides of the filters.

7 Claims, 5 Drawing Sheets

FILTER CONNECTOR

FIELD OF THE INVENTION

This invention generally relates to the art of electrical connectors and, particularly, to a filter connector which mounts a plurality of electronic components, such as capacitors or the like, between the terminals and a shorting bar of the connector. The shorting bar may be a ground plate. The invention also relates to a method of fabricating the filter connector.

BACKGROUND OF THE INVENTION

There are a variety of electrical connectors which are termed "filter" connectors, in that an electronic component, such as a capacitor, is coupled between the terminals of the connector and a ground plate or plane or a shorting bar normally mounted to a face of a dielectric housing of the connector. The filters are used to suppress electromagnetic interference and radio frequency interference entering the connector system.

One of the problems with such filter connectors simply is their cost. Normally, a ground plate or shorting bar is fabricated of stamped and formed conductive metal material and must be mounted separately to the dielectric housing of the connector. Terminals then are mounted in the connector housing. The filter capacitors then must be coupled between the terminals and the ground plate. These steps are time consuming and require assembly tooling, all of which adds considerably to the cost of the connectors. In a mass production environment, reliability and performance often have much to be desired. Typically, the terminals are mounted or inserted into a connector housing in one direction, the capacitors are mounted or inserted into the housing in a different direction and the ground plate or shorting bar is mounted or assembled in the same or different direction. All of these assembly operations require relatively expensive assembly tooling. The present invention is directed to solving these various problems.

SUMMARY OF THE INVENTION

An object, therefore, of the invention is to provide a new and improved filter connector of the character described, along with a method of fabricating or assembling the connector.

In the exemplary embodiment of the invention, the connector includes a dielectric housing having a mounting face. At least one row of terminal-receiving passages are formed in the housing through the mounting face. A row of filter-receiving pockets are formed in the housing through the mounting face respectively in alignment with the passages, and with one side of each pocket communicating with its respective passage. A slot is formed in the mounting face of the housing and extends along the row of pockets in communication with opposite sides thereof. A plurality of terminals are mounted into the passages. A plurality of filters are inserted into the pockets through the mounting face, with one side of the filters respectively engageable with the terminals. A single shorting bar is inserted into the slot in the housing through the mounting face and into engagement with opposite sides of the plurality of filters.

According to one aspect of the invention, biasing means are provided between the shorting bar and the filters to bias the filters against the terminals. Preferably, the biasing means is integral with the shorting bar. As disclosed herein, the shorting bar is stamped and formed of sheet metal material, and the biasing means comprise an integral leaf spring portion of the bar engageable with each filter. Therefore, the filters can be easily mounted fairly loosely into their respective passage, and the biasing means or leaf spring is effective to tighten the assembly.

According to other aspects of the invention, the terminals comprise terminal pins. The filters comprise capacitors. The housing has a mating face and a terminating face, and the mounting face comprises the terminating face of the connector. In the preferred embodiment, a plurality of generally parallel rows of the terminal-receiving passages are formed in the housing along with a corresponding plurality of generally parallel rows of the filter-receiving pockets. One of the slots is formed along each row of pockets to relieve the shorting bar.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
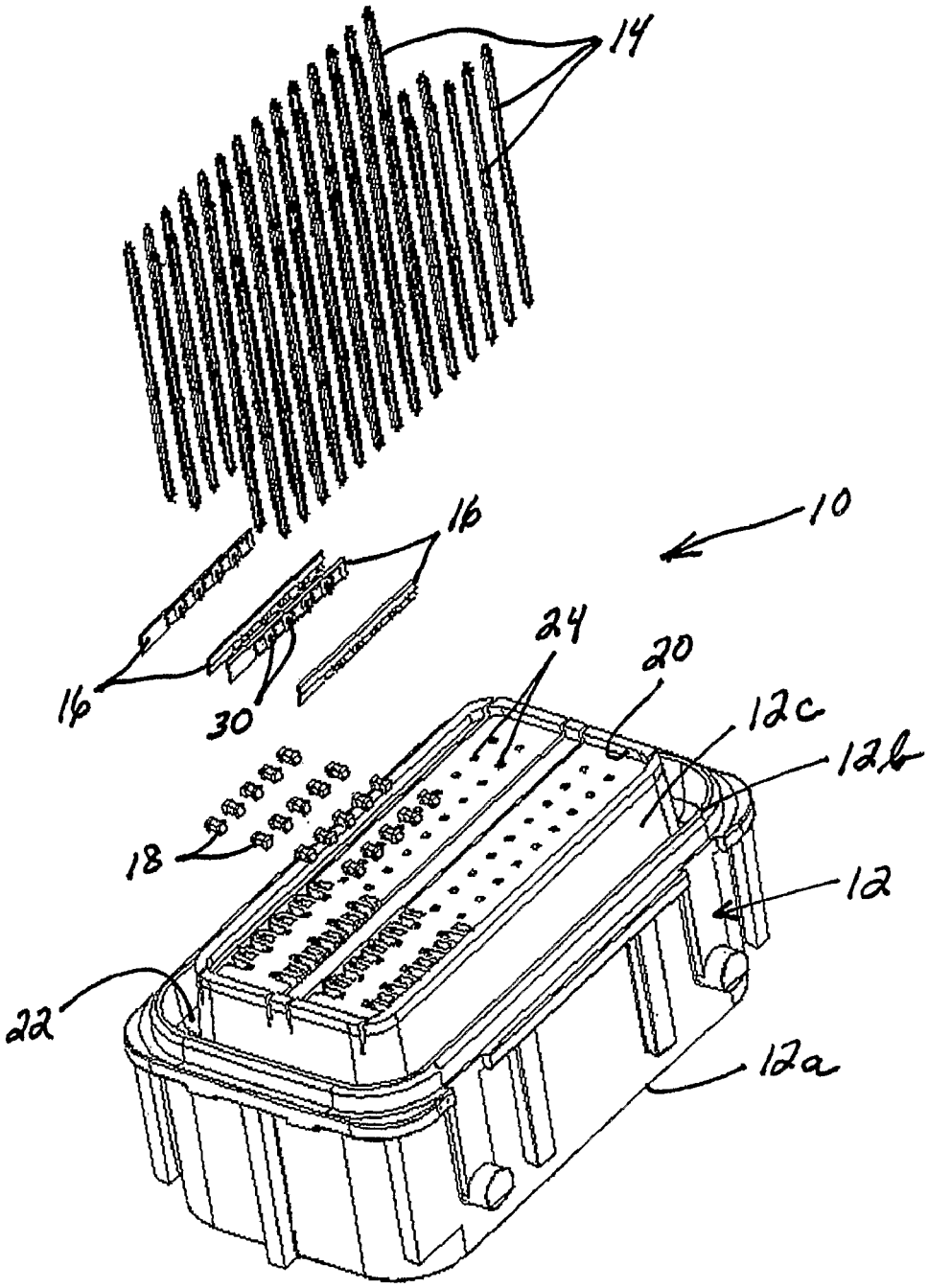
FIG. 1 is an exploded perspective view of an electrical connector embodying the concepts of the invention.

Referring to the drawings in greater detail, and first to FIG. 1, the invention is embodied in a filtered electrical connector, generally designated 10, which includes a dielectric housing, generally designated 12, a plurality of terminals in the form of terminal pins 14, a plurality of ground plates or shorting bars 16 and a plurality of filters in the form of capacitors 18. Before proceeding further, it should be noted that housing 12 of connector 10 receives four rows of terminal pins 14, with fourteen pins in each row. On the other hand, the drawing shows only five capacitors 18 for each row. This has been done in order to avoid cluttering the drawings, with the understanding that there may be fourteen capacitors for each row of fourteen terminal pins. In addition, shorting bars 16 are shown in FIG. 1 as being cut-off to engage only the five capacitors in the rows thereof. It should be understood that each shorting bar will run the entire length of the row of fourteen capacitors corresponding to the fourteen pins in each row.

With those understandings, housing 12 of connector 10 may be molded of dielectric material or the like. The housing includes a mating face 12*a* and a terminating face 12*b*. Under this configuration, the terminating face will be considered the mounting face herein and in the claims hereof. The mounting face is recessed, as at 20, to receive an encapsulant (not shown) after terminal pins 14, shorting bars 16 and capacitors 18 have been inserted into the housing through the mating face 12*a* or the mounting face 12*b* thereof. The housing has a plug portion 12*c* at the terminating end thereof, and the plug portion is surrounded by a peripheral groove 22. A metal casing of the connector (not shown) is assembled into the peripheral groove, and shorting bars 16 are grounded to the metal casing as will be seen hereinafter.

Figure 2:
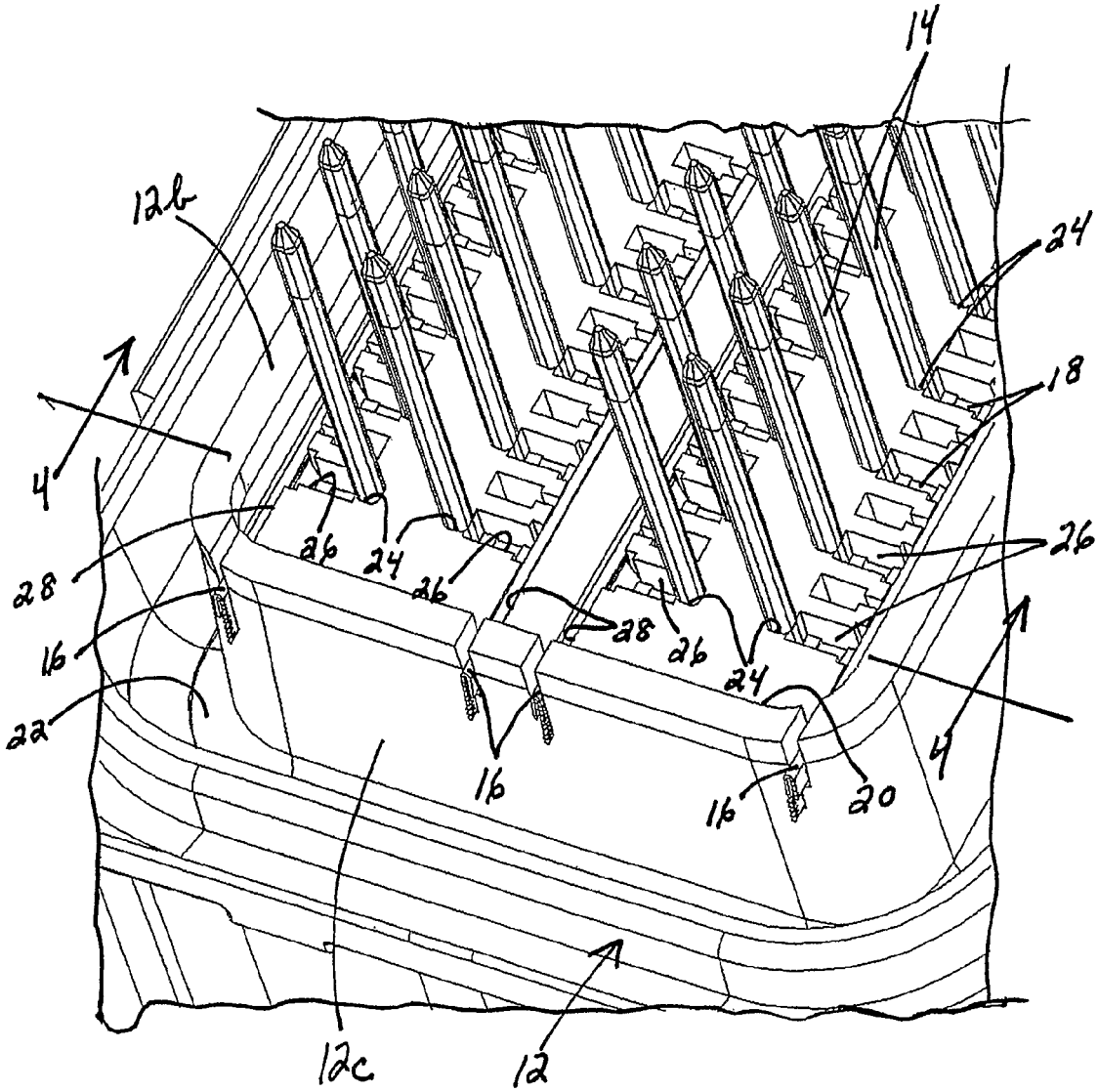
FIG. 2 is an enlarged, fragmented perspective view of one end of the connector in assembled condition.
Figure 3:
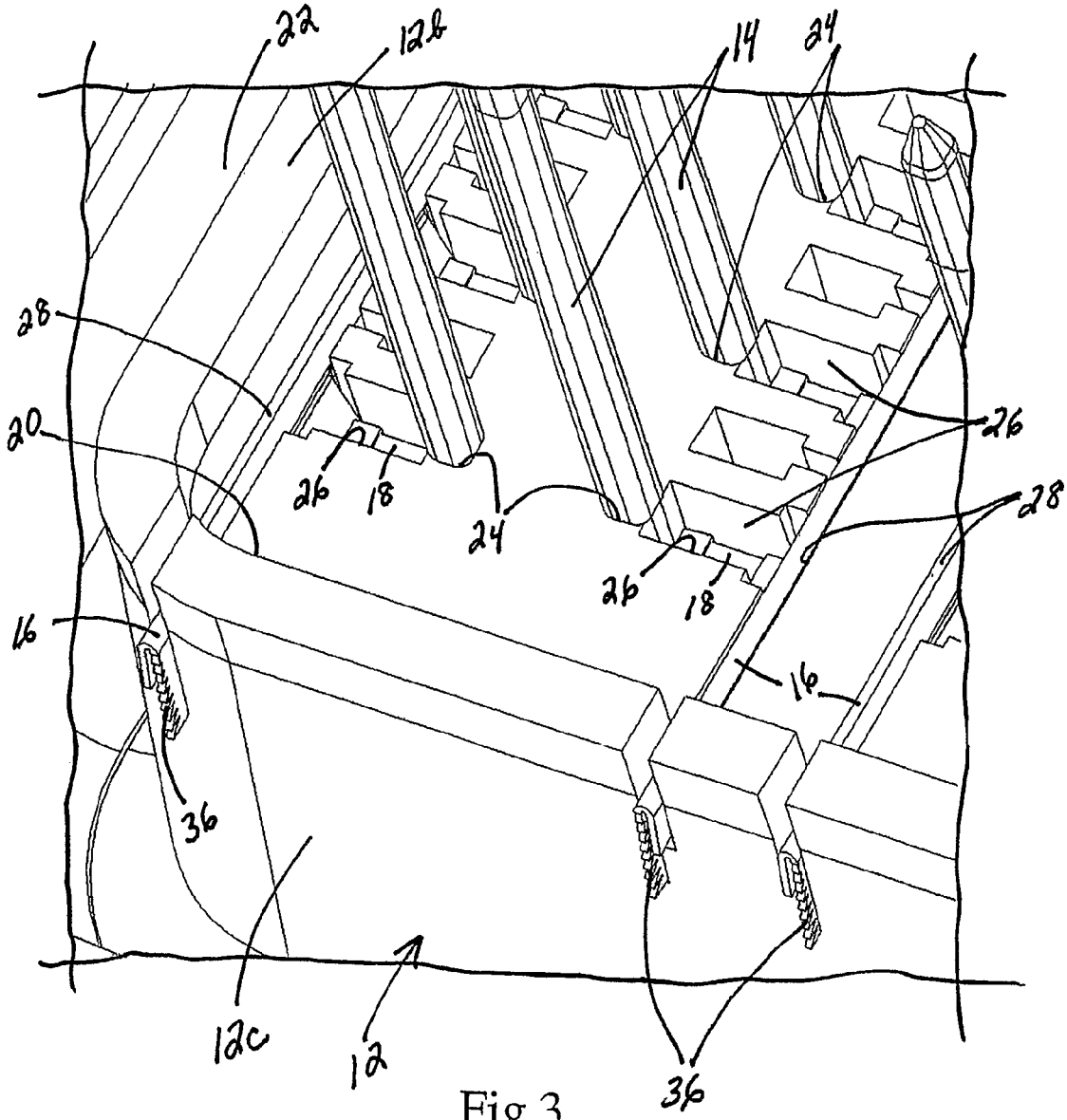
FIG. 3 is a fragmented perspective view similar to that of FIG. 2 but which has been further enlarged to facilitate the illustration.

Referring to FIGS. 2 and 3 in conjunction with FIG. 1, housing 12 has four rows of terminal-receiving passages 24 through mounting face 12*b* thereof. The housing has four rows of filter-receiving pockets 26 through the mounting face and respectively in alignment with the terminal-receiving passages. A slot 28 is formed in the mounting face of the housing and extends along each row of filter-receiving pockets 26 and in communication with opposite sides of the filter-receiving pockets.

Figure 4:
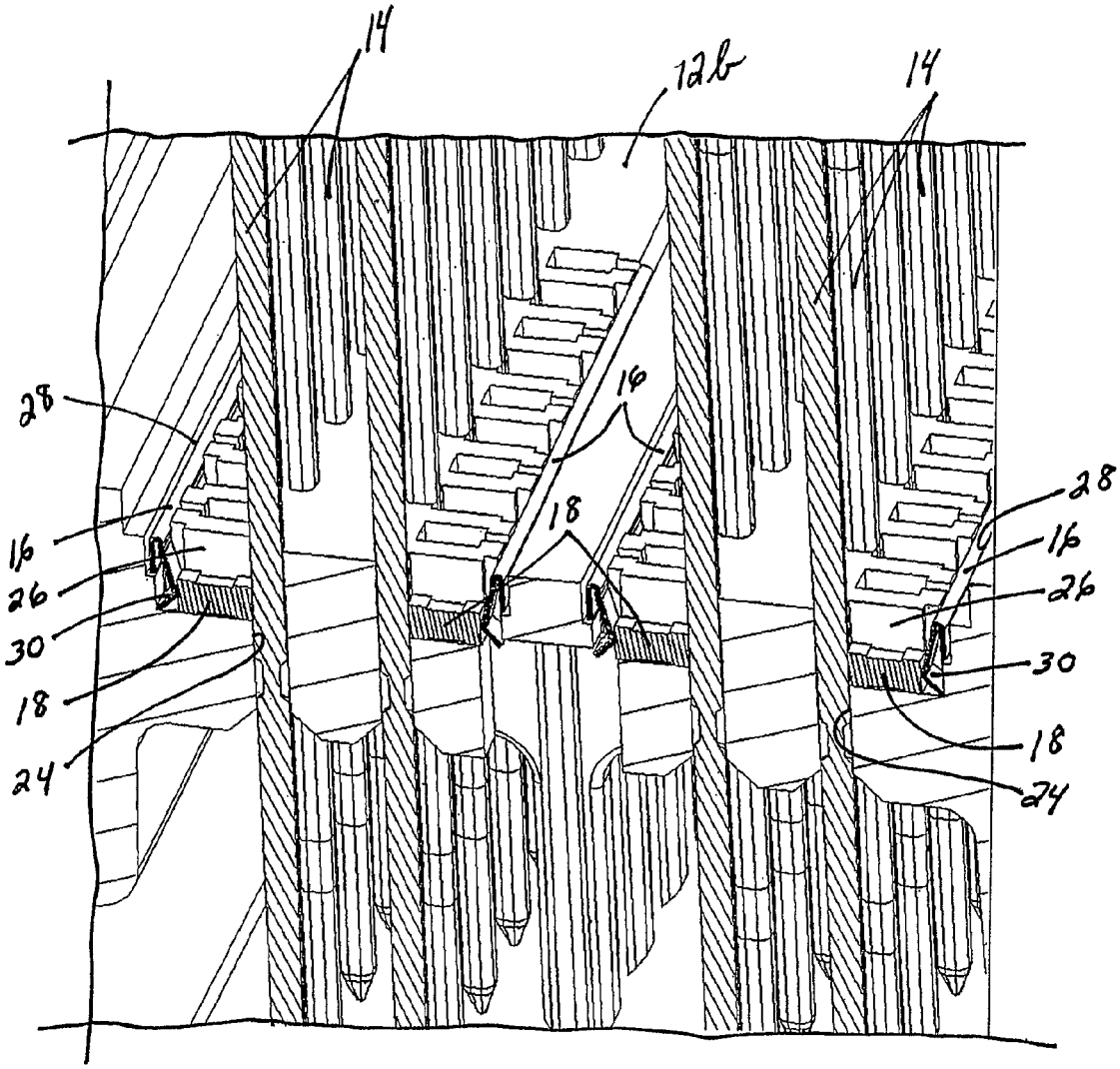
FIG. 4 is a vertical section taken generally along line 4-4 of FIG. 2.

Further details of the various components will now be described in conjunction with a unique method of fabricating or assembling connector 10, referring to the enlarged depictions of FIGS. 4 and 5. Specifically, terminal pins 14 first are inserted into passages 24 in housing 12 through the mating face 12*a* or the mounting face 12*b* thereof. The terminals are inserted into the passage fairly tightly, as by a press-fit which secures the terminals in their assembled condition within the passages. Capacitors 18 then are inserted or assembled into filter-receiving pockets 26, again through mounting face 12*b* of the housing. A unique concept of the invention is that the capacitors are assembled into the pockets fairly loosely, or at least loose enough to make it quite easy to insert the capacitors into their respective sockets. In actual practice, the capacitors are "gang placed" into their respective pockets, one row at a time. The relative loose fit between the capacitors and the pockets facilitate this gang insertion process.

Shorting bars 16, having a first bar portion and a second bar portion folded over the first bar portion, are then inserted into their respective generally narrow slots 28, again through mounting face 12*b* of the housing. The shorting bars are stamped and formed of sheet metal material, such as tin-plated steel. The shorting bars are formed with biasing means in the form of a plurality of leaf springs 30 which respectively engage capacitors 18 to bias the capacitors against the terminal pins. In essence, the springs are effective to "tighten" the assembly in view of the somewhat loose assembly of the capacitors into their respective pockets.

Figure 5:
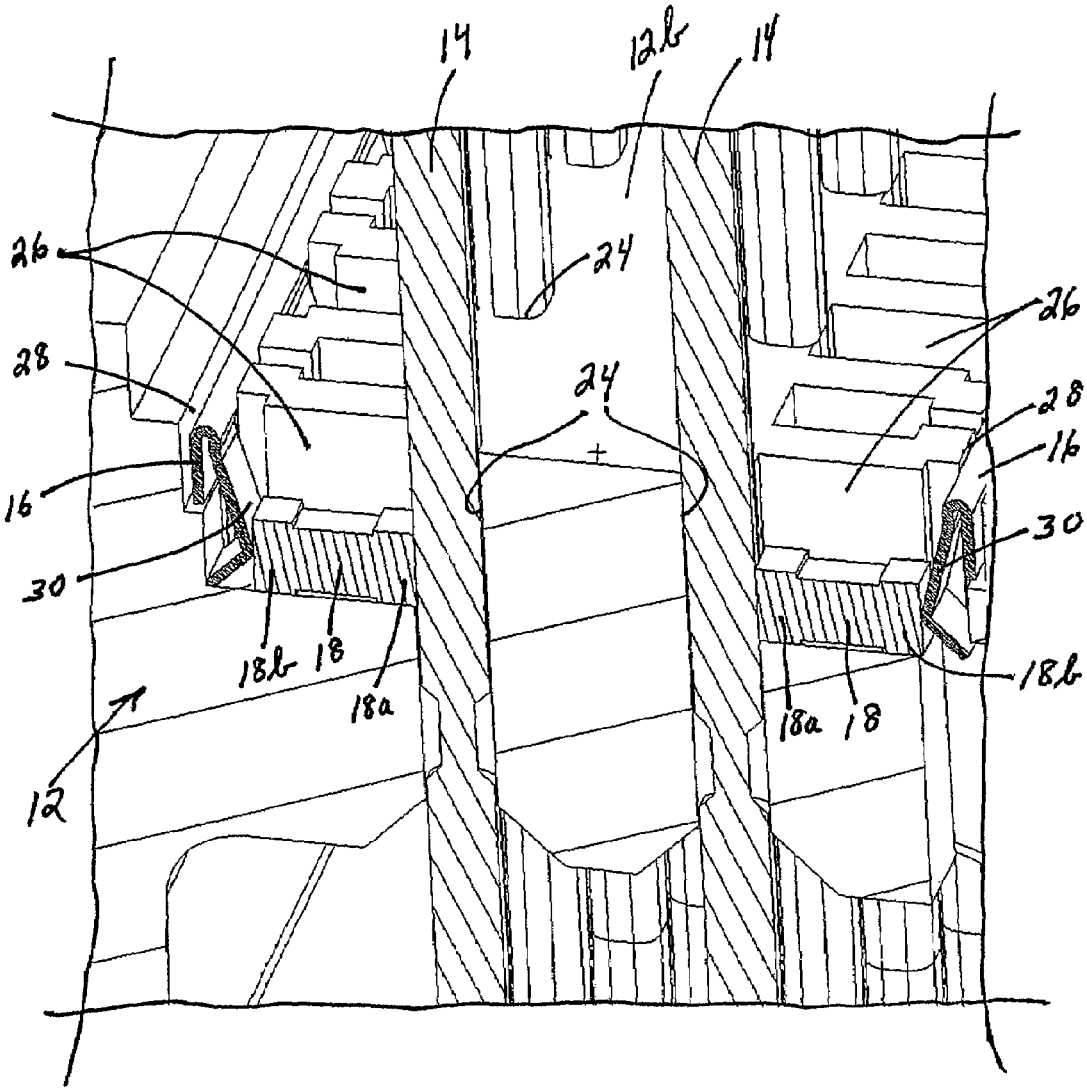
FIG. 5 is a depiction of a portion of the sectional view of FIG. 4, which has been further enlarged to facilitate the illustration.

When finally assembled as shown in FIG. 5, one side 18*a* of each capacitor 18 is biased by the respective leaf spring 30 through one side of the respective pocket 26 which communicates with the respective terminal-receiving passage. The respective leaf, spring 30 engages an opposite side 18*b* of the capacitor in view of the fact that the opposite side of the respective pocket 26 communicates with the respective slot 28 that receives the respective shorting bar 16.

When terminals pins 14, capacitors 18 and shorting bars 16 are assembled into the housing, recess 20 in mounting face 12*b* is filled with a sealing encapsulant. The encapsulant is poured into the recess in liquid form and is allowed to cure and completely seal the entire mounting face of the connector through which the terminal pins, capacitors and shorting bars were assembled. In addition, the encapsulent secures all components with respect to one another to maintain mechanical and electrical connections throughout its life.

Finally, referring back to FIG. 3, it can be seen that the extreme outer edges of shorting bars 16 are jagged or saw-toothed, as at 36. These irregular or sharp edges bite into the metal casing within groove 22 of the housing to ground the shorting bars to the metal casing.

It can be seen from the foregoing that the fabrication or assembly of connector 10 is made quite simple by assembling terminals pins 14, capacitors 18 and shorting bars 16 into the same face of the housing. This considerably simplifies the assembly tooling for the connector. The terminal pins can be assembled from either the mating face or the mounting face of the housing regardless of the orientation of the housing, because of the press-fit of the terminal pins into passages 24. Sealing the connector also is made quite simple in that the sealing encapsulant must simply fill one recess at one face of the connector to seal all of the passages/pockets/slots into which the components are assembled.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A filter connector, comprising:

a dielectric housing having a mounting face, at least one row of terminal-receiving passages in the housing through the mounting face, for each row of terminal-receiving passages a respective row of filter-receiving pockets in the housing through the mounting face respectively in alignment with said passages with one side of each pocket communicating with its respective passage, and a respective generally narrow slot in the mounting face of the housing extending along each row of pockets and in communication with an opposite side of each pocket;

a plurality of terminals inserted into said passages in the housing;

a plurality of filters inserted into said pockets in the housing through the mounting face thereof, with one side of the filters respectively engageable with the terminals; and a single shorting bar respectively inserted into each slot in the housing through the mounting face thereof into engagement with an opposite side of each of the plurality of filters in the associated row of pockets, each shorting bar formed of a sheet metal material and having a first bar portion and a second bar portion folded over said first bar portion and providing a plurality of integral leaf springs for engagement with the respective opposite sides of the plurality of filters to bias the filters against the terminals.

2. The filter connector of claim 1 wherein said housing has a mating face opposite said mounting face and said mounting face constitutes a terminating face of the connector.

3. The filter connector of claim 1 wherein said terminals comprise terminal pins.

4. The filter connector of claim 1 wherein said filters comprise capacitors.

5. The filter connector of claim 1, including a plurality of generally parallel rows of said terminal-receiving passages in the housing, a corresponding plurality of generally parallel rows of said filter-receiving pockets, one of said slots along each row of pockets, and a corresponding plurality of shorting bars respectively inserted into said slots.

6. The filter connector of claim 1, wherein said shorting bar includes jagged outer edges extending outward from opposite sides of said mounting face.

7. The filter connector of claim 1 wherein said mounting face has a recessed area about said passages, pockets and slot, and the recessed area is filled with a sealing encapsulant.

* * * * *